US005908066A

United States Patent [19]

Rauch

[11] Patent Number: 5,908,066

[45] Date of Patent: Jun. 1, 1999

[54] PROCESS AND DEVICE FOR CHARGING FOUNDRY MACHINES

[75] Inventor: Erich Rauch, Gmunden, Austria

[73] Assignee: Ing. Rauch Fertigungstechnik Gesellschaft m.b.H., Gmunden, Austria

[21] Appl. No.: 08/913,663

[22] PCT Filed: Mar. 21, 1996

[86] PCT No.: PCT/AT96/00054

§ 371 Date: Sep. 19, 1997

§ 102(e) Date: Sep. 19, 1997

[87] PCT Pub. No.: WO96/30142

PCT Pub. Date: Oct. 3, 1996

[30] Foreign Application Priority Data

Mar. 24, 1995 [AT] Austria ..... 529/95

[51] Int. Cl.[6] ..... B22D 1/00; B22D 37/00; B22D 35/06; B67D 1/04

[52] U.S. Cl. ..... 164/133; 164/337; 222/590; 222/593; 222/595

[58] Field of Search ..... 164/133, 337, 164/113; 222/590, 593, 595

[56] References Cited

U.S. PATENT DOCUMENTS

| | | | |
|---|---|---|---|
| 4,635,706 | 1/1987 | Behrens | 164/133 |
| 5,407,000 | 4/1995 | Mercer, II et al. | 164/133 |
| 5,411,240 | 5/1995 | Rapp et al. | 164/337 |
| 5,477,907 | 12/1995 | Meyer et al. | 164/133 |

FOREIGN PATENT DOCUMENTS

| | | | |
|---|---|---|---|
| 323 922 | 10/1974 | Austria . | |
| 0 252 318 | 1/1988 | European Pat. Off. . | |
| 0 609 197 | 8/1994 | European Pat. Off. . | |
| 1 134 183 | 8/1962 | Germany . | |
| 11 34 183 | 8/1962 | Germany . | |
| 11 50 182 | 6/1963 | Germany . | |
| 21 11 462 | 9/1972 | Germany . | |
| 2 307 846 | 8/1974 | Germany . | |
| 30 50 183 | 1/1983 | Germany . | |
| 33 44 537 | 6/1985 | Germany . | |
| 40 29 386 | 3/1992 | Germany . | |
| 59-212150 | 12/1984 | Japan | 164/133 |

OTHER PUBLICATIONS

Light Metals and Metal Industry; vol. 27, No. 319, Dec. 64, p. 40 Volkswagen: "Nitrogen aids automatic metering of".

*Primary Examiner*—Patrick Ryan
*Assistant Examiner*—I.-H. Lin
*Attorney, Agent, or Firm*—Collard & Roe, P.C.

[57] ABSTRACT

For charging casting machines with non-ferrous molten metals, melt (S) is supplied from a withdrawal chamber (6) of a melting furnace (1) having a gas atmosphere to the filling hole (18) of a casting machine. To achieve an economic, easily dosable charging of the melt, the metered melt (S) is pumped up inside the withdrawal chamer (6) via a metering pump (12) and is drained towards the filling hole (18) via a discharge pipe (15) extending through the furnace wall, where through inlet nozzles (11) opening into the withdrawal chamber (6) a pulsed supply of gas to the withdrawal chamber (6) is effected to support the melt flow.

8 Claims, 1 Drawing Sheet

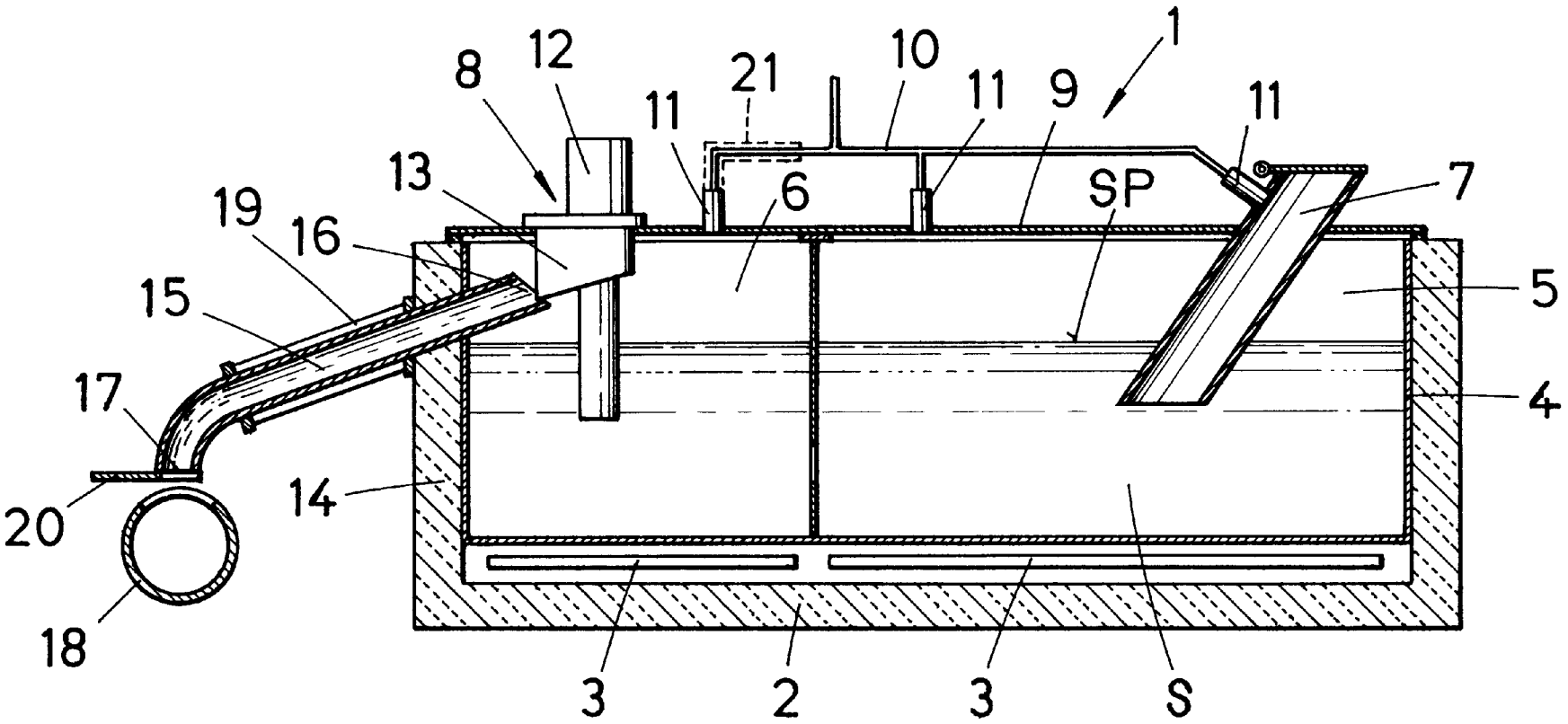
1
2
3
3
4
5
6
7
8
9
10
11
11
11
12
13
14
15
16
17
18
19
20
21
SP
S

PROCESS AND DEVICE FOR CHARGING FOUNDRY MACHINES

CROSS-REFERENCE TO RELATED APPLICATION

This application is a 371 of PCT/AT 96/00054, filed on Mar. 21, 1996.

BACKGROUND OF THE INVENTION

1. Field of the Invention

This invention relates to a method for charging casting machines with non-ferrous molten metals, according to which melt is supplied batchwise from a withdrawal chamber of a melting furnace having a gas atmosphere to the filling hole of a casting machine, and to an apparatus for carrying out this method.

2. Description of the Prior Art

For the batchwise charging of casting machines, melt has so far been discharged from a melting furnace by means of gas pressure conveyance (EP-A 0,252,318) or by means of piston pumps or spiral pumps (DE-B 1,134,183) via pump components extending beyond the cover of the melting furnace, so that long conveying distances along with the difficulties of an undesired premature slag formation and solidification have to be accepted and expensive holding and conveying means are required. The charging of the melt thus requires very much handling and maintenance above all in the case of easily oxidizable non-ferrous metals, impairs the availability of the machine, and there is also a poor metering accuracy.

SUMMARY OF THE INVENTION

It is therefore the object underlying the invention to provide a method as described above, which provides for an economic charging of the melt with a high metering accuracy and constancy. In addition, there should be created a comparatively inexpensive apparatus for carrying out the method.

This object is solved by the invention in that the metered melt is pumped up inside the withdrawal chamber and is drained towards the filling hole via a discharge pipe extending through the furnace wall, where for supporting the melt flow a pulsed supply of gas to the withdrawal chamber is effected. Thus, the flow path of the melt is at least partly integrated in the furnace space of the withdrawal chamber, and the discharge of the melt is effected on a comparatively short path by simply draining it along the discharge pipe, so that inexpensive pumping means and heating means are sufficient for a proper discharge of the melt. Due to the pulsed supply of gas to the withdrawal chamber the metering accuracy is improved in the desired sense, as the gas pulses ensure the complete and clearly limited discharge of the melt through the discharge pipe and can in addition provide a protective atmosphere for the melt in the discharge area when using a protective gas. Due to the pulsed supply of gas to the withdrawal chamber the discharge velocity of the gas through the discharge pipe is increased, and there is formed a discharging gas piston for the melt flow. This gas piston prevents that after the pump has stopped during the metered discharge of the melt, the boundary layers of the outflowing melt close to the wall stay back behind the melt particles more remote from the wall inside the discharge pipe, so that the final idling would take longer and involve an afterdripping. Due to the increase of the gas velocity inside the discharge pipe, however, the layers of the outflowing melt close to the wall can be accelerated and the metering process can thus be terminated more quickly, there is no afterdripping and the metering accuracy is increased. Despite the simple melt discharge measures a perturbation-insensitive and exactly dosable conveyance of the melt is ensured.

In the case of aluminum or the like, the withdrawal chamber could even be supplied with air or the like, but when oxygen-free protective gas, preferably a mixture of nitrogen or argon and sulfur hexafluoride, is supplied to the withdrawal chamber, melt oxidations can safely be prevented also in the discharge area and in the case of delicate metals such as magnesium or the like. Since the metered discharge of the melt is a turbulent melt flow, which does not cover the entire cross-section of the discharge pipe, and the melt surface is permanently torn up and newly formed, there cannot form a sealing protective layer as in the usual melt baths, so that special care should be taken that there is an oxygen-free protective gas atmosphere, and the usual protective gas compositions, which consist of gas mixtures with air and carbon dioxide or the like, are not suited.

For the melt charging of casting machines, two- or multi-chamber furnaces are used, which comprise a gas-fillable withdrawal chamber with a melt conveying means. An economic discharge of the melt is achieved in that the melt conveying means consists of a metering pump sealed to the outside, preferably a spiral pump, with an outlet disposed above the melt surface, and of an inclined discharge pipe extending through the side wall of the furnace to the outside, which discharge pipe has an inlet opening lying in the outlet area of the metering pump and a discharge opening aligned with the filling hole of the casting machine, and in that inlet nozzles for the pulsed supply of gas open into the withdrawal chamber. By means of a simple and robust metering pump an easy melt charging can be achieved, where as metering pump there can preferably be used a spiral pump in accordance with the Austrian Patent 399,205. This spiral pump conveys melt into the discharge pipe with a high metering accuracy, through which discharge pipe the melt freely flows out by means of the gas blown into the withdrawal chamber as a gas piston via the inlet nozzles and on the shortest way reaches the filling hole of the casting machine, so that difficulties as a result of slag formation and temperature fluctuations in the melt are prevented with little constructional effort and in a way that ensures an easy handling and maintenance. Expediently, the discharge opening of the discharge pipe is provided with a closure, so that a major gas consumption as a result of outflowing gas between the metering processes can be avoided.

When the discharge pipe is provided with a heating means outside the withdrawal chamber, the discharge conditions for the melt can easily be kept the same over the entire length of the discharge pipe, so that the functional reliability and the metering accuracy are increased.

To avoid a cooling of the melt as a result of the pulsed supply of gas in particular in larger plants, a gas preheating means may be associated to and/or disposed before the inlet nozzles, so that the gas temperature can be adapted to the melt temperature.

BRIEF DESCRIPTION OF PREFERRED EMBODIMENT

In the drawing, the subject-matter of the invention is represented in detail by way of example with reference to a schematic representation of the plant in a partial cross-section.

DETAILED DESCRIPTION OF PREFERRED EMBODIMENT

A melting furnace 1 consists of an insulating housing 2 with suitable heating means 3 and a furnace insert 4. The furnace insert 4 constitutes one or several melt holding or cleaning chambers 5 and a withdrawal chamber 6, where the melt chamber 5 is provided with a material feeding means 7, and the withdrawal chamber 6 is provided with a melt conveying means 8. The chambers 5, 6 are gas-tightly sealed with a cover 9 and can be supplied with gas via gas lines 10 and inlet nozzles 11.

The melt conveying means 8 comprises a metering pump 12 sealed to the outside with an outlet 13 disposed above the melt surface SP inside the withdrawal chamber 6 as well as an inclined discharge pipe 15 extending to the outside through the furnace side wall 14, which discharge pipe has an inlet opening 16 lying in the withdrawal chamber 6 in the outlet area of the metering pump 12 and a discharge opening 17 in the filling area of a filling hole 18 for a casting machine not represented in detail. The discharge pipe 15 is temperature-controlled via a separate heating means 19 and may have an automatic closure 20 at its outlet opening 17.

For the batchwise charging of the filling hole 18 metered melt S is pumped up from the withdrawal chamber 6 through the metering pump 12 and poured into the discharge pipe 15 through the inlet opening 16, through which discharge pipe it freely flows off to the outside into the filling hole 18. For supporting the melt flow, there is a pulsed supply of gas to the withdrawal chamber 6 via the inlet nozzles 11 after the pump has stopped, where for preheating the gas a gas preheating means 21 may be associated to the inlet nozzles 11. This gas acts on the melt in the discharge pipe 15 like a gas piston which accelerates the melt flow and clearly limits the same without afterdripping, where an oxygen-free protective gas in addition prevents a melt oxidation. The protective gas flowing out of the discharge opening 17 also exerts its protective effect in the vicinity of the filling hole 18, which improves the charging of the melt. The closure 20 is closed after each discharge of melt, so as to avoid an unnecessary consumption of protective gas.

I claim:

1. A method of charging a casting machine with a non-ferrous metal, which comprises the steps of (a) pumping up a metered melt of the non-ferrous metal inside a withdrawal chamber of a melting furnace, the withdrawal chamber having a gas atmosphere, (b) draining batches of the pumped-up, metered melt from the inside of the withdrawal chamber towards a filling hole of the casting machine through a discharge pipe extending from the inside of the withdrawal chamber through a side wall to the filling hole, and (c) supplying a pulsed supply of gas to the withdrawal chamber to support the flow of the melt through the discharge pipe.

2. The method of claim 1, wherein the gas is an oxygen-free protective gas.

3. The method of claim 2, wherein the oxygen-free protective gas is a mixture of nitrogen and sulfur hexafluoride.

4. The method of claim 2, wherein the oxygen-free protective gas is a mixture of argon and sulfur hexafluoride.

5. An apparatus for charging a casting machine through a filling hole with a non-ferrous metal, which comprises (a) a melting furnace including a withdrawal chamber adapted to hold a melt of the non-ferrous metal at a predetermined level, (b) inlet nozzle means for delivering a pulsed supply of gas to the inside of the withdrawal chamber above the level of the melt, (c) a metering pump accommodated inside the withdrawal chamber and sealed to the outside, (1) the metering pump having an outlet disposed above the level of the melt, and (d) an inclined discharge pipe extending through a withdrawal chamber side wall, (1) the discharge pipe having an inlet opening in communication with the outlet opening of the metering pump and a discharge opening outside the withdrawal chamber in alignment with the filling hole of the casting machine.

6. The apparatus of claim 5, further comprising a closure for the discharge opening of the discharge pipe.

7. The apparatus of claim 5, further comprising a heating means for the discharge pipe outside the withdrawal chamber.

8. The apparatus of claim 5, further comprising a gas preheating means for the inlet nozzle means.

* * * * *